United States Patent [19]

Sanger

[11] Patent Number: 4,566,246

[45] Date of Patent: Jan. 28, 1986

[54] MODULAR STRUCTURE ASSEMBLIES

[76] Inventor: George F. Sanger, 211 Confederate Way, Seabrook, Harris, Tex. 77586

[21] Appl. No.: 619,230

[22] Filed: Jun. 11, 1984

[51] Int. Cl.[4] ..... E04B 7/06

[52] U.S. Cl. ..... 52/648; 52/DIG. 10; 52/81; 403/342; 446/126

[58] Field of Search ..... 52/80, 81, 648, DIG. 10; 403/171, 172, 173, 174, 175, 176, 342; 446/126

[56] References Cited

U.S. PATENT DOCUMENTS

| | | | |
|---|---|---|---|
| 1,557,894 | 10/1925 | Sturgis | 403/342 |
| 1,739,740 | 12/1929 | Stoeltzen | 446/126 X |
| 3,080,662 | 3/1963 | Brumlik | 52/DIG. 10 |
| 3,542,407 | 11/1970 | Brown | 403/172 |
| 3,851,980 | 12/1974 | Worth et al. | 403/172 |
| 3,877,824 | 4/1975 | Jury | 403/176 X |
| 4,065,890 | 1/1978 | Fenner | 52/648 X |

FOREIGN PATENT DOCUMENTS

| | | | |
|---|---|---|---|
| 477946 | 10/1951 | Canada | 446/126 |
| 651283 | 10/1962 | Canada | 403/342 |
| 1108433 | 8/1955 | France | 52/DIG. 10 |
| 613144 | 11/1960 | Italy | 403/173 |

*Primary Examiner*—Donald G. Kelly
*Assistant Examiner*—Richard E. Chilcot, Jr.
*Attorney, Agent, or Firm*—Richards, Harris, Medlock & Andrews

[57] ABSTRACT

Modular constructions and connector assemblies therefore. The modular construction comprises a plurality of spode units with elongated key members extending between the spode units and interconnected to form a modular framework. Adapter collars and retaining collars are employed to connect the key members to the spode units to carry torsional and longitudinal stress. In one embodiment, the spode units include union joints having a plurality of spaced slots which are adapted to receive conforming projecting lugs on the adapter collars. The slots and lugs are symmetrically located so that the adapter collar and key member can be connected to the spode unit in a plurality of angularly displaced relationships. The key member-spode unit structure may be provided with a cover tube so that the structure will carry or transmit fluid.

8 Claims, 14 Drawing Figures

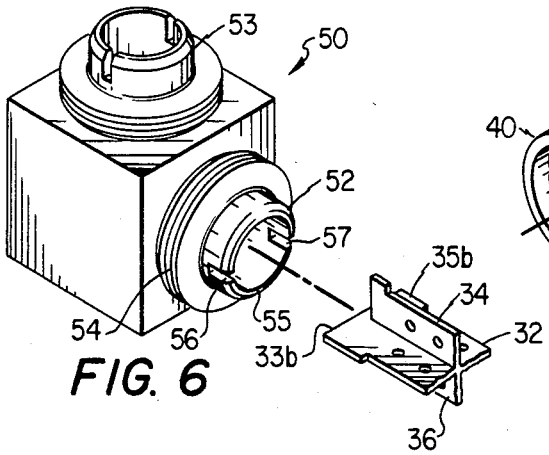
FIG. 6
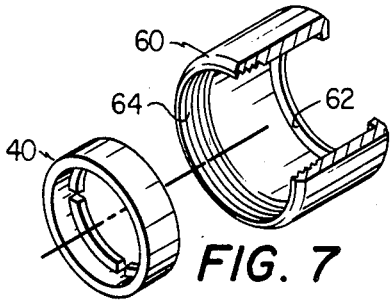
FIG. 7
FIG. 9
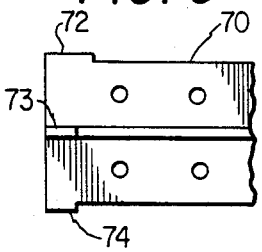
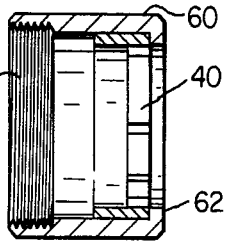
FIG. 8
FIG. 10
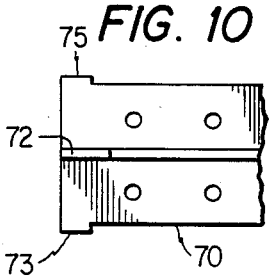
FIG. 11
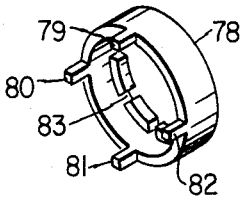
FIG. 12
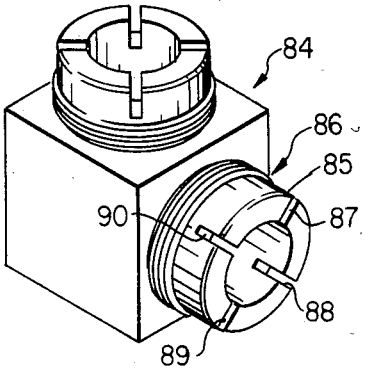
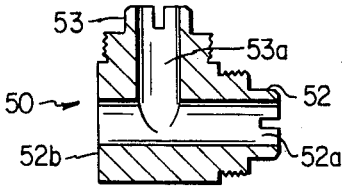
FIG. 13
FIG. 14
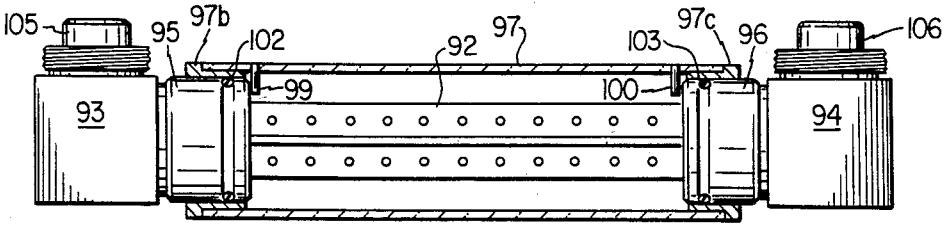

MODULAR STRUCTURE ASSEMBLIES

TECHNICAL FIELD

This invention relates to modular construction and more particularly to modular frame assemblies and connector assemblies for use in modular construction.

BACKGROUND OF THE INVENTION

In the construction of a modular structural element into a framework, various means are employed to connect one load bearing structural element to another. One basic type of modular construction involves the use of threaded couplings such as elbows, t-couplings, and the like which have internal threads adapted to receive external threads on the ends of tubing members. Another type of modular construction includes the use of multi-socket connects which receive the structural framework elements in a friction fit such as found in a so-called "tinker toy" fabricating toys. Such frictional joints will not carry a substantial amount of torsional load and where this is necessary or desirable spline-type couplings may be used. Yet another type of coupling useful in modular construction is disclosed in the article entitled "Connector for Composite Tubes" NASA tech briefs, Fall 1982, p. 53. As disclosed in this reference, tubular structural members may be connected by the use of tab or web elements which may be joined in an interfitting relationship.

DISCLOSURE OF THE INVENTION

In accordance with the present invention, there is provided a new and improved structural connector assembly for use in modular construction. The assembly and its associated parts may be employed in constructing a modular framework of any desired shape. The basic unit employed in the present invention comprises an elongated key member which functions as a load bearing structure. An adapter collar is slideable onto the key member from the end thereof and is provided with means which, when the adapter collar is in place, cooperate with the key member to prevent longitudinal displacement of the adapter collar off of the end of the key member. There is further provided a spode unit having at least one union joint which is adapted to be connected with the key member. A retaining collar is slideable over the key member and the adapter collar and has an internal shoulder. This internal shoulder conforms with the adapter collar to abut against the adapter collar from the rear thereof. The retaining collar also has a forward portion which is adapted to be connected to the union joint of the spode member. Cooperative longitudinal connecting means are provided on the retaining collar and the union joint of the spode member. These means function to cure the retaining collar in the spode member against relative movement longitudinally of the key member. The assembly is further provided with cooperative torsional connecting means associated with the union joint of the spode unit and at least one of the key member and the adapter collar. This secures the spode unit and the key member in a relationship whereby the key member and the spode unit are locked together against stress in torsion, i.e., a torsional load may be transferred between the spode-member and the key member.

In a preferred embodiment of the invention, the key member is of an angulated cross-section and comprises a plurality of longitudinal ribs having radially extending detent protrusions at the ends thereof. The adapter collar is provided with a internal angular shoulder which has a plurality of slots conforming in angular location to the detent protrusions of the key member. Thus, the adapter collar may be slideably displaced onto the key member by alignment of the slots with the detent protrusions. Thereafter the adapter collar is angularly displaced so that the shoulder abuts the back sides of the detent protrusions thus preventing displacement of the adapter collar from the end of the key member. The torsional connection is provided by at least one slot in the spode-member union joint which is adapted to receive the end of at least one of the longitudinal ribs of the elongated key member.

In yet a further aspect of the present invention, there is provided a modular frame construction formed of a plurality of spode units and key members as described previously. Each spode member has a plurality of union joints. The key members extend between pairs of spode units with each pair sharing a common spode unit so that the key members are interconnected through the spodes to provide the framework. The connection of the key members and spode units is accomplished through the means of adapter collars and retaining collars as described above. Preferably, at least a portion of the spode members have internal passageways interconnecting the union joints of the spode members. Elongated cover tubes envelope at least some of the key members and extend between the pairs of spode members to which the key members are secured. Packing means are provided between the ends of the cover tube and the corresponding retaining collars to provide for a fluid seal.

BRIEF DESCRIPTION OF THE DRAWINGS

FIG. 6 is an exploded perspective view illustrating the spode unit and the associated end of the key member;

FIG. 7 is an exploded perspective view showing the relative locations of the adapter collar and the retaining collar as they are placed on the key member;

FIG. 8 is a longitudinal section showing the adapter collar seated within the retaining collar when both are in place upon the key member (not shown);

FIG. 9 is a side elevational view of a portion of a modified form of key member showing the end thereof;

FIG. 10 is a plan view of the end of the key member shown in FIG. 9;

FIG. 11 is a perspective view of a modified form of an adapter collar for use with the key member of FIG. 9;

FIG. 12 is a perspective view of a modified form of a spode unit for use with the key member and adapter collar of FIGS. 9–12;

FIG. 13 is a side view partly in section showing passage means intersecting the union joints of a spode member; and FIG. 14 is a side view with parts broken away showing a key member extending between a pair of spode units and provided with an elongated cover tube.

BEST MODES FOR CARRYING OUT THE INVENTION

Figure 1:
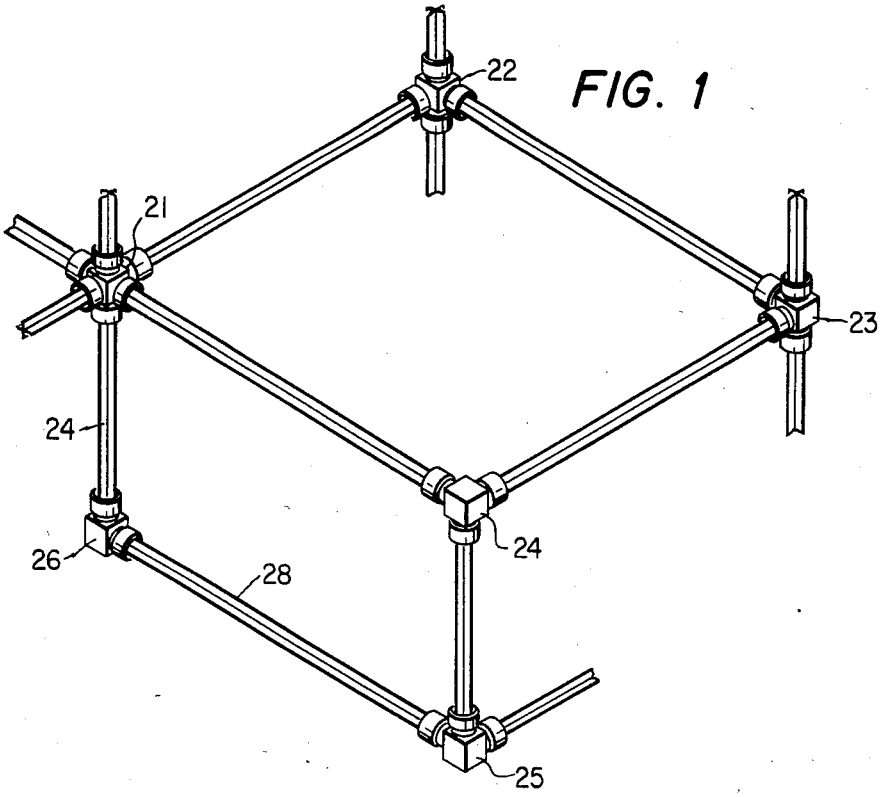
FIG. 1 is a perspective view of a modular frame construction embodiment of the present invention.

Turning first to FIG. 1 of the drawings, there is illustrated a perspective view of a modular framework embodying the present invention. The framework shown in FIG. 1 is comprised of spode members 21–26 and a plurality of key members which are connected to and extend between pairs of spode units. Each of the spode units in the framework shown in FIG. 1 has a plurality of union joints as necessary to interconnect with the desired number of key members. Thus, in arriving at a grid-type modular framework with key members connected at right angles as shown in FIG. 1, the spode units will take the form of hexahedron with union joints formed on two to six faces depending upon the number of key members to be connected. For example, spode unit 26 which interconnects only with two key members indicated by reference numerals 28 and 29, need have only two union joints spaced angularly by 90°. Spode unit 22 should have at least 4 union joints and spode unit 21, which is located within the interior of the framework, would of necessity be provided with 6 union joints, one on each face. The key members are secured to the respective spode units through the interconnection of the adapter and retaining collars with the spode-member union joints as described below.

Figure 3:
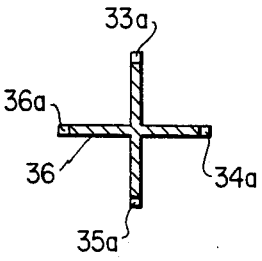
FIG. 3 is a sectional view taken along line 3—3 of FIG. 2.
Figure 2:
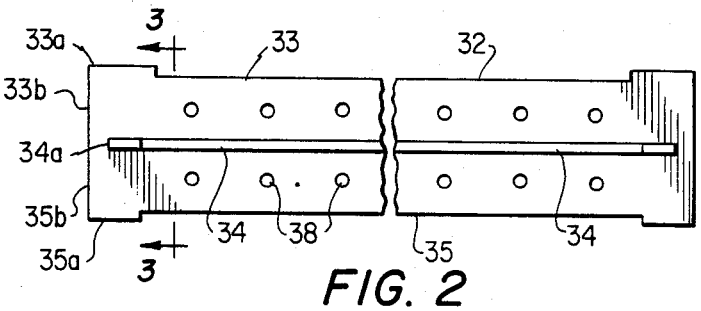
FIG. 2 is a side elevation of one form of a key member employed in the present invention.
Figure 4:
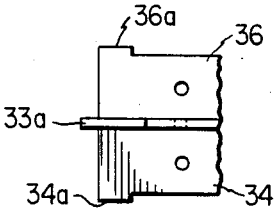
FIG. 4 is a plan view of the end of the key member shown in FIG. 2.

A preferred form of key member having a cruciform cross-section is illustrated in FIGS. 2, 3 and 4. As shown in FIG. 2, the key member 32 comprises four longitudinal arms or ribs indicated by reference numerals 33, 34, 35 and 36. The longitudinally extending ribs are perforated as indicated by reference numeral 38 in order to provide for a decrease in weight of the key member with only a minimal impact on its strength and stiffness. Also holes 38 allow for indexed attachment locations to support auxiliary equipment or closeout surfaces to the extent required in mutually perpendicular planes to the axes of the key member. Each end of the key member is provided with radially extending detent protrusions 33*a*, 34*a*, 35*a* and 36*a* which extend radially outward from the rib sections. As shown in FIGS. 2 and 4 the detent protrusions 34*a*, 35*a* and 36*a* terminate at a common longitudinal location along the key member where as the detent protrusion 33*a* extends to the rear thereof by a small distance.

As also shown in FIGS. 2 and 4, the opposed ribs 33 and 35 extend outwardly from the other pair of opposed arms 34 and 36. As described below, these extending portions provide projecting segments 33*b* and 35*b* which mate with corresponding slots in the spode unit in order to lock the two together against relative rotation about the axis of the key member. That is, the two are locked together so that they will transmit significant torsional stress.

Figure 5:
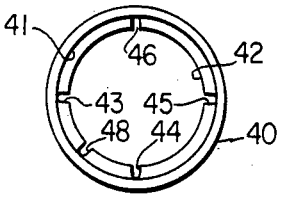
FIG. 5 is an end view of one type of an adapter collar employed in the present invention.

FIG. 5 illustrates one form of adapter collar useful in the present invention. As shown in FIG. 5, the adapter collar 40 has an inner wall 41 of sufficient diameter to fit over the detent protrusions 33*a*–36*a*. The collar has an interior annular shoulder 42 having an inner diameter such that the shoulder will fit over the ribs of the elongated key member but not the detent protrusions. Shoulder 42 is provided with slots 43, 44, 45 and 46 which are spaced from one another by 90° so that they conform exactly in configuration to the detent protrusions on the end of the key member. In addition, the shoulder 42 is provided with an additional slot 48 which is displaced angularly by 45° from a pair of the conforming slots. From an examination of FIG. 5 and FIG. 3, it can be seen that the four symmetrical slots can be aligned with the detent protrusions and the adapter collar then slid into place at a location where the annular shoulder is behind the detent protrusions. The adapter collar is then rotated through an angle of 45° so that the elongated detent protrusion 33*a* is aligned with slot 48. When the adapter collar is moved toward the end of the key member, the protrusion 33*a* fits into slot 48 to lock the adapter collar against rotational movement relative to the key member. The abuttment of the annular shoulder against the rear portions of the remaining detent protrusions 34*a*, 35*a*, and 36*a* will prevent displacement of the adapter collar from the end of the key member.

FIG. 6 is a perspective view of a spode unit and an associated key member indicating the manner in which the key member is secured to the spode unit to carry both longitudinal and torsional forces. The spode unit 50 is shown as being of a hexahedral form having union joints 52 and 53 on adjoining surfaces. As shown in the drawing, the union joint 52 includes a threaded male coupling section 54 and a reduced receiver section 55. The receiver section 55 is provided with diametrically opposed slots 56 and 57 which receive the projecting segment portions 33*b* and 35*b* of the key member. When the projecting portion of the key member is in place within the slots, the slightly recessed ends of arms 34 and 36 are in abutting relationship with the outer surface of the receiving section.

FIG. 7 is a perspective view showing the relative positions of the adapter collar 40 and the retaining collar 60, with part broken away, when both are in place on the key member. The retaining collar 60 has an interior wall of a diameter greater than the outer diameter of the adapter collar so that the adapter collar can be seated within the retaining collar. The retaining collar has an internal annular shoulder 62 which is adapted to abut against the adapter collar from the rear. Thus, the internal shoulder has an inner diameter which is smaller than the outer diameter of the adapter collar. With the adapter collar in place on the key member and oriented so that the elongated detent protrusion 33*a* is located within slot 48, the retaining collar fits over the adapter collar. The retaining collar is provided with a forward segment having internal threads 64 which mate with the threads 54 on the spode joint.

In assembling the components shown in FIGS. 6 and 7, the retaining collar is placed over the key member with the threaded end faced outwardly and the adapter collar then put in place and rotated 45° so that the elongated detent protrusion 33*a* lines up with slot 48. The key member is then brought into contact with the spode member with the projecting segments 33*b* and 35*b* brought into engagement with the slots 56 and 57 in the union joint. The retaining collar is moved forward over the adapter collar and the internal threads 65 brought into engagement with the threaded portion of the union joint. The retaining collar can be tightened by hand to the point where the key member is securely locked to the spode unit against both longitudinal and torsional movement.

FIG. 8 is a sectional view showing the relationship between the adapter collar and the retaining collar when the two are in place in the assembled connection.

The spode joint and the key member element are not shown. As illustrated in FIG. 8, the annular shoulder 62 abuts against the rear of the adapter collar such that when the retaining collar is secured to the spode joint the assembly is held rigidly in place.

Turning now to FIGS. 9 and 10, there is shown an alternative embodiment of the invention employing a modified elongated key member 70. FIG. 9 is a side elevation of the key member showing only the end portion thereof. FIG. 10 is a plan view of the key member shown in FIG. 9. The key member 70 is also a cruciform cross section and is similar to the key member 32 described previously in that one radially extending detent protrusion 72 extends rearwardly with respect to the remaining three protrusions 73, 74 and 75.

The key member shown in FIGS. 9 and 10 is provided with an adpater collar 78 shown in FIG. 11. This adapter collar is similar to the adapter collar previously described with reference to FIG. 5 but includes a plurality of outwardly projecting lug segments 79, 80, 81 and 82. The collar 78 is provided with an internal annular shoulder having four slots conforming to the detent protrusions on the key member and an additional slot displaced from one of the conforming slots by an angle of 45°, similarly as in the case of collar 40.

The spode member for use with the assembly of FIGS. 9 through 11 is shown in FIG. 12. The spode unit 84 is similar to the previously described unit with the exception that the reduced receiver section 85 of the union joint 86 is provided with four slots 87, 88, 89, and 90 which conform in their locations to protruding lugs 79–82 extending outwardly from the adapter collar. In this case it will be noted that the four longitudinally extending ribs of the key member 70 terminate in a flush end without projecting segments as in the case of the key member 32.

In assembly of the components shown in FIGS. 9–12, the retaining collar and adapter collar are placed over the key member similarly as described previously. The adapter collar is rotated 45° to align the slot 83 with the rearwardly extended detent protrusion 72. This relationship secures the adapter collar to the key member in a torsional stress transmitting relationship. The adapter collar is then brought into contact with the spode unit union joint 85 with the four projecting lugs entering into the conforming slots on the face of the union joint. The retaining collar (not shown) is then moved into contact with the union joint and hand tightened on the threaded section of the joint to provide a rigid assembly. It is to be recognized that the symmetrical location of the union joint slots and the adapter collar projecting lugs is advantageous in that it allows the key member to be secured to the spode unit in any one of four angularly displaced positions. Either more or less projecting lugs and conforming spode unit slots may be provided to provide greater or fewer alternative positions. For example, if the adapter collar were provided with three symmetrically projecting lugs (spaced circumferentially from one another by 120°) and the slots in the union joint surface similarly located, the key member could be placed in any one of three angular positions.

The key member may be formed in any suitable cross-sectional configuration which, when the material of which the key member is formed is considered provides sufficient strength. It usually will be preferred to form the key member in an angulated cross section, and more particularly, in the cruciform cross section described previously. The cruciform cross section offers a number of advantages. It is inherently characterized as having geometric right-angle properties. It has relatively good strength in longitudinal and transverse directions, that is along the X,Y and Z planes. It has a low weight to strength ratio, particularly when formed of a lightweight material such as aluminum alloy and when perforated as illustrated.

Other cross-sectional shapes may also be employed. For example, the cross section of the key member may be Y-shaped, L-shaped or T-shaped. It also may have a star-shaped cross-sectional configuration provided by more than 4 longitudinal ribs. In some instances, a flat section may also be employed. That is, with reference to FIGS. 2–4 described previously, the opposed longitudinal ribs 34 and 36 may be removed, leaving only a flat section as provided by ribs 33 and 35. A configuration of this nature usualy would be suitable only where strength is required in only one transverse direction.

The key member may also have a solid or hollow cross section of any suitable configuration such as a circle or a square. In this case it is, of course, still necessary to provide radially extending detent protrusions such as the protrusions 33*a*–36*a* (FIGS. 2, 3 and 4) or 72–75 FIGS. 9 and 10.

In some cases, it may also be desirable to form the key member in a configuration in which transverse dimensions of the end sections are reduced relative to the remainder of the key member. For example, considering the key member 32 shown in FIG. 2, the end sections may be reduced somewhat with respect to the interior longitudinal portion of the key member. This would enable the use of realtively small spode units and retainer and adapter rings relative to the transverse dimensions of the major portion of the key member.

It will be recognized that through the use of spode units of different configurations, the key members can be assembled in a modular framework of any shape. For example, the angles between adjoining sides of the spode units can be adjusted such that the spode units can be employed to connect the key members in the general shapes of spheres, cylinders, or any other predetermined shape.

The interconnections between the retaining collars and the spode-member union joints can be provided by any suitable means. While a threaded connection as shown usually will be preferred for reasons of simplicity and reliability, so called "quick release" connections can also be employed. Such connections must, of course, provide for a secure locking of the retaining collar and the spode member together against relative longitudinal movement.

In a further embodiment of the invention, spode units may be employed which have internal passageways interconnecting with the union joints of the spode members. Such spode units may be employed in construction of assemblies as described below with respect to FIG. 14 or for other purposes, e.g., to provide conduits for electrical connectors and the like. This embodiment of the invention is illustrated in FIG. 13 which is a sectional view of the spode member 50 shown in FIG. 6. As shown in FIG. 13, passageways 52*a* and 53*a* extend from union joints 52 and 53, respectively, and intersect within the interior of the spode member. Passageway 52*a* is shown extending through the spode member where it provides an opening in wall 52*b*. Thus the passage may provide a fluid conduit or an electrical conduit, for example, which extends to apparatus exteriorly of the modular construction framework. Alternatively, it will be recognized that passageway 52*a* may terminate short of wall 52*b* so that communication is only between the union joints.

The present invention may also be employed in the construction of modular assemblies in which a part or all of the framework members are adapted to hold or transport fluids in either liquid or gaseous form. This embodiment of the invention is illustrated in FIG. 14 which is a side elevation with parts broken away of a key member 92 extending between a pair of spode units 93 and 94. The key member 92 is secured to the spode unit by means of adapted collars (not shown) and retaining collars 95 and 96. A cover tube 97 formed of a transparent plastic cylinder extending between metal collars 97*b* and 97*c*, fits over the retaining collars as shown. The cover tube is provided with inwardly extending stop members 99 and 100 which secure the cover tube against longitudinal movement relative to the retaining collars. At least one of the stop members is removable and is placed in the position shown after the cover tube is put into place. Suitable packing means such as O-rings 102 and 103 are placed in grooves about the retaining collars to provide for a fluid tight seal between the cover tube and the retaining collars. Alternatively, the O ring grooves can be provided within the interior wall of the cover tube, or any other suitable sealing means can be employed.

It will be recognized that the assembly shown in FIG. 14 can be used as part of an overall modular framework or it can be a self contained unit. In this latter case appropriate closure caps or injection port caps will be threaded over the exposed spode unit union joints such as the joints 105 and 106.

Having described specific embodiments of the present invention, it will be understood that modifications thereof may be suggested to those skilled in the art, and it is intended to cover all such modifications as fall within the scope of the appended claims.

I claim:

1. In a connector assembly for a modular construction, the combination comprising:

a. an elongated key member having a plurality of longitudinal ribs having radially extending detent protrusions at the ends thereof, at least one of said detent protrusions extending longitudinally rearwardly of the other of said detent protrusions;

b. an adapter collar having an annular internal shoulder provided with a plurality of slots therein conforming to the detent protrusions of said key member whereby said adapter collar is slideable over the end of said key member when said slots and detent protrusions are aligned and having at least one additional slot displaced angularly from said conforming slots and adapted to receive said at least one of said detent protrusions upon the angular displacement of said adapter collar relative to said key member whereby said adapter collar is secured against removal from the end of said key member;

c. a spode unit having a connecting joint;

d. a retaining collar adapted to fit over said key member and said adapter collar and having an internal shoulder adapted to abut against said adapter collar from the rear and a forward portion adapted to be connected to the union joint of the spode unit;

e. cooperative connecting means on said retaining collar and said spode unit connecting joint for securing said retaining collar and said connecting joint against relative movement longitudinally of said key member;

f. and means cooperatively associated with said spode unit connecting joint and at least one of said key member and said adapter collar for securing said key member and said spode unit joint whereby said key member and said spode unit joint are locked in a torsional stress bearing relationship.

2. The combination of claim 1 wherein said torsional connecting means includes at least two circumferentially spaced slots at the end of said spode unit union joint which are adapted to receive conforming projecting segments extending outwardly from at least one of said key members and said adapter collar.

3. The combination of claim 2 wherein at least one of said projecting segments is provided by at least one rib of said key member.

4. The combination of claim 3 wherein said spode joint is provided with at least two circumferentially spaced slots adapted to receive conforming radially spaced projecting segments of said key member.

5. The combination of claim 1 wherein said torsional connection means comprises at least one slot in the end of said spode joint member and adapted to receive at least one protruding lug extending outwardly from said adapter collar.

6. The combination of claim 5 further comprising a plurality of slots in the end of said spode joint member whereby said key member can be connected to said spode joint in a plurality of angularly displaced relationships.

7. The combination of claim 5 further comprising a plurality of lugs extending outwardly from said adapter collar and a plurality of slots in said spode-member joint adapted to receive said adapter collar lugs, said slots and said lugs being located at circumferentially symmetrical locations whereby said adapter collar and key member can be connected to said spode unit joint in a plurality of angularly displaced relationships.

8. The combination of claim 7 wherein said adapter collar lugs extend outwardly from said adapter collar at the radial locations of said adapter collar slots which are adapted to receive the detent protrusions of said key member.

* * * * *